US009308922B2

(12) United States Patent
Sain et al.

(10) Patent No.: US 9,308,922 B2
(45) Date of Patent: Apr. 12, 2016

(54) CAMBERED FRAME SYSTEM FOR INTERMODAL RAIL CARS

(71) Applicant: Load Distribution Technologies LLC, Cleveland, OH (US)

(72) Inventors: Bernard S. Sain, Jacksonville, FL (US); David N. Messer, Avon Lake, OH (US)

(73) Assignee: Load Distribution Technologies, LLC, Cleveland, OH (US)

( * ) Notice: Subject to any disclaimer, the term of this patent is extended or adjusted under 35 U.S.C. 154(b) by 0 days.

(21) Appl. No.: 14/282,291

(22) Filed: May 20, 2014

(65) Prior Publication Data

US 2014/0341701 A1 Nov. 20, 2014

Related U.S. Application Data

(60) Provisional application No. 61/825,268, filed on May 20, 2013.

(51) Int. Cl.

| | |
|---|---|
| ***B60P 7/06*** | (2006.01) |
| ***B65G 7/00*** | (2006.01) |
| ***B61D 3/20*** | (2006.01) |
| ***B61D 45/00*** | (2006.01) |

(52) U.S. Cl.

CPC ..... *B61D 3/20* (2013.01); *B61D 45/007* (2013.01)

(58) Field of Classification Search

CPC ..... B61D 3/20; B61D 45/007; B65D 88/129; B65D 88/022; B60P 7/13; B60P 7/132

USPC ..... 410/31, 35, 44, 46, 76, 77, 78, 80, 82

See application file for complete search history.

(56) References Cited

U.S. PATENT DOCUMENTS

| | | | | |
|---|---|---|---|---|
| 3,480,174 | A * | 11/1969 | Sherwood | 220/1.5 |
| 4,047,341 | A | 9/1977 | Bernardi | |
| 4,290,642 | A | 9/1981 | Wise | |
| 5,183,375 | A * | 2/1993 | Fenton et al. | 410/35 |
| 6,210,088 | B1 * | 4/2001 | Crosby | 410/35 |
| 6,877,939 | B2 | 4/2005 | Tomkins et al. | |
| 7,007,815 | B2 | 3/2006 | Anderson et al. | |
| 2004/0155003 | A1 | 8/2004 | Anderson et al. | |
| 2010/0191615 | A1 * | 7/2010 | Thomas | 705/26 |
| 2012/0076603 | A1 * | 3/2012 | Crane et al. | 410/46 |
| 2012/0076607 | A1 | 3/2012 | Crane et al. | |

FOREIGN PATENT DOCUMENTS

| | | |
|---|---|---|
| CN | 2011 04 27 | 4/2011 |
| EP | 0 679 566 | 11/1995 |

* cited by examiner

*Primary Examiner* — Saul Rodriguez
*Assistant Examiner* — Mark Hageman
(74) *Attorney, Agent, or Firm* — Tarolli, Sundheim, Covell & Tummino LLP

(57) ABSTRACT

A method of transporting containers on a rail car is described. The method includes the steps of, first, providing a frame having at least two longitudinal beams and at least two cross beams. The at least two cross beams extend substantially perpendicular to, and interconnect, the at least two longitudinal beams. The two longitudinal beams may be cambered along the length of the beams. Next, the method includes the step of attaching a first container to a first end of the frame. Then, the first container and the frame are loaded into the rail car. Finally, the method includes the step of loading a second container into the rail car and onto a second end of the frame.

11 Claims, 7 Drawing Sheets

CAMBERED FRAME SYSTEM FOR INTERMODAL RAIL CARS

CROSS-REFERENCE TO RELATED APPLICATIONS

The present application claims priority to U.S. Provisional Patent Application Ser. No. 61/825,268 filed May 20, 2013 entitled "Cambered Frame System for Intermodal Rail Cars", the entire contents of which are incorporated herein by reference in its entirety for all purposes.

TECHNICAL FIELD

The present invention relates to the railroad transportation industry, and more particularly to a cambered frame system for supporting and distributing loads in an intermodal rail car.

BACKGROUND OF THE INVENTION

Approximately 65,000 intermodal rail car cars are used in the United States. Intermodal rail cars are specifically designed to transport both domestic and International Standards Organization (ISO) containers. ISO containers are eight feet wide, and either eight feet six inches tall or nine feet six inches tall, and are typically either 20 or 40 feet long, although larger sizes are available. 20-foot long ISO containers have a gross weight (lading and tare) load limit of 67,200 pounds. Intermodal rail cars may be loaded with two tiers of containers. With ISO containers, the lower tier generally consists of either two 20-foot ISO containers positioned end-to-end in the rail car or one 40-foot container, and the upper tier generally consists of one 40-foot ISO container stacked on top of either the two 20-foot ISO containers or the single 40-foot container.

The average intermodal rail car is between 10-12 years old and, as a result of overstress created by fully loaded 20-foot containers, many of the intermodal rail cars have become structurally compromised. In particular, the central portion of the intermodal rail car potentially becomes stressed to the point of failure of the supporting horizontal steel structure. As a result of this stress caused by the fully loaded 20-foot containers, the Association of American Railroads (AAR) reduced the maximum allowable weight limit for 20-foot ISO containers from 67,200 pounds to 52,900 pounds effective January 2012, thereby decreasing transportation efficiency of the US intermodal rail industry. This invention will restore the ability of the current intermodal rail fleet to again carry fully loaded 20-foot containers without damaging the rail cars.

SUMMARY OF THE INVENTION

A method of transporting containers on a rail car is described. The method includes the steps of, first, providing a frame having at least two longitudinal beams and at least two cross beams. The at least two cross beams extend perpendicular to, and interconnect, the at least two longitudinal beams. The two longitudinal beams may be cambered along the length of the beams. Next, the method includes the step of attaching a first container to a first end of the frame. Then, the first container and the frame are loaded into the rail car. Finally, the method includes the step of loading a second container into the rail car and onto a second end of the frame.

A method of transporting a plurality of frames on a rail car is also described. The method includes the steps of, first, assembling a plurality of frames, each of the plurality of frames having at least two longitudinal beams and at least two cross beams. The at least two cross beams extend perpendicular to, and interconnect, the at least two longitudinal beams. The at least two longitudinal beams are cambered along the length of the beams. Next, the method includes the step of stacking the plurality of frames on top of another to create a frame stack unit. Then, the neighboring frames of the plurality of frames of the frame stack unit are secured together. Finally, the method includes the step of loading the frame stack unit into the rail car.

A method of designing an apparatus for reinforcing a flat bed rail car is also described. The method includes the step of, first, providing a frame having at least two longitudinal beams and at least two cross beams. The at least two cross beams extend parallel to, and interconnect, the at least two longitudinal beams. The at least two longitudinal beams are cambered along the length of the beams. Next, the method includes the step of determining a minimum and maximum combined weight of a load to be carried by the rail car. Then, a combination of beam size and camber for the at least two longitudinal beams is selected based on the minimum and maximum combined weight.

DETAILED DESCRIPTION

Figure 1:
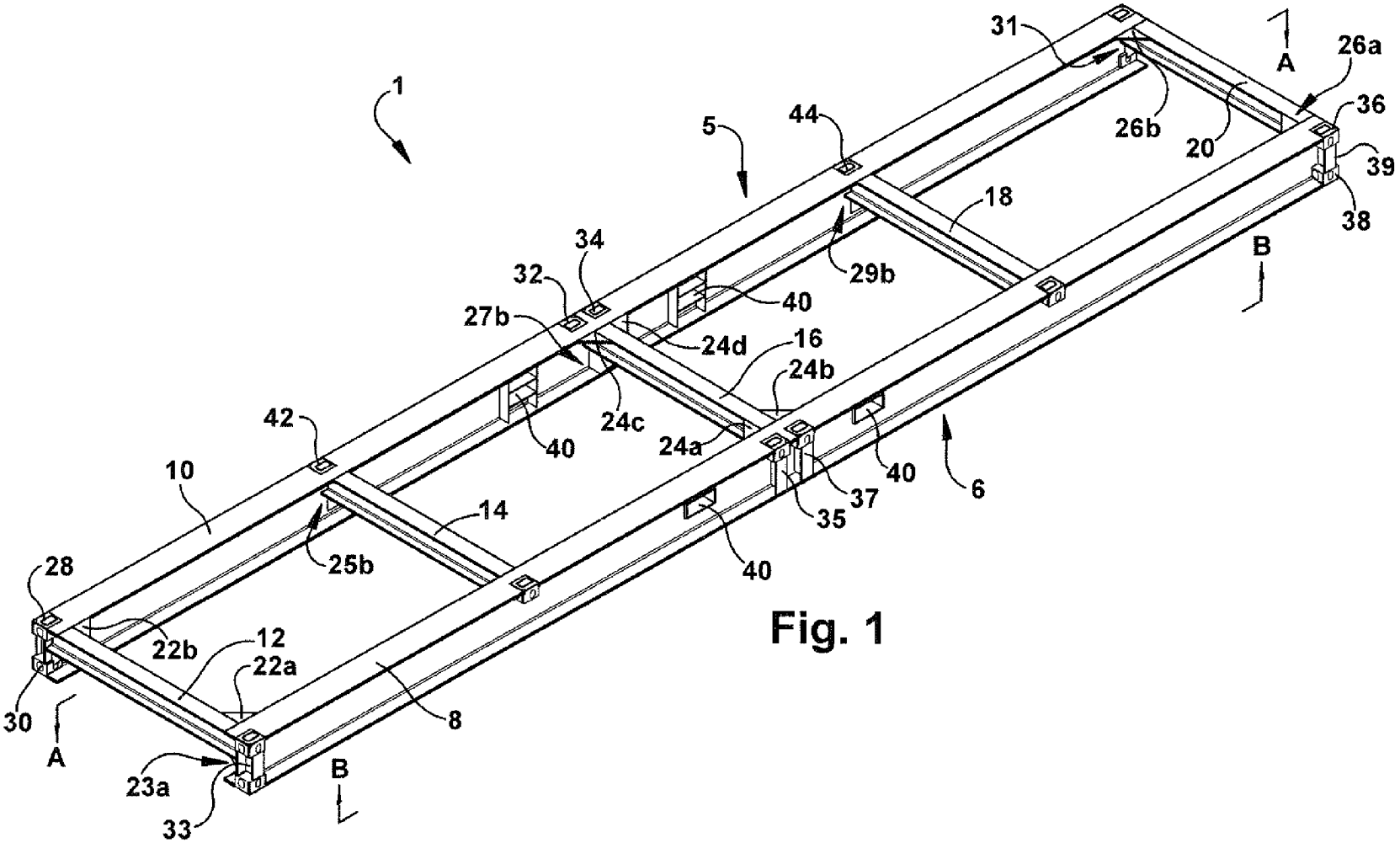
FIG. 1 shows a perspective view of an example embodiment of a cambered frame system.

Now referring to FIGS. 1-11, an example embodiment of a cambered frame system 1 is shown. The frame system 1 has a first end 2 and a second end 4, and an upper surface 5 and a lower surface 6.

The frame system 1 includes a first longitudinal beam 8 and a second longitudinal beam 10. The longitudinal beams 8, 10 extend between the first end 2 and second end 4 of the frame system 1. A plurality of cross beams 12, 14, 16, 18, 20 extend between, and interconnect, the longitudinal beams 8, 10. In the illustrated example embodiment the frame system 1 includes five cross beams 12, 14, 16, 18, 20 that are evenly spaced along the longitudinal beams 8, 10 between the first end 2 and the second end 4. However, the frame system 1 may be provided with fewer or more cross beams to customize the frame system 1 for a particular application.

Figure 2:
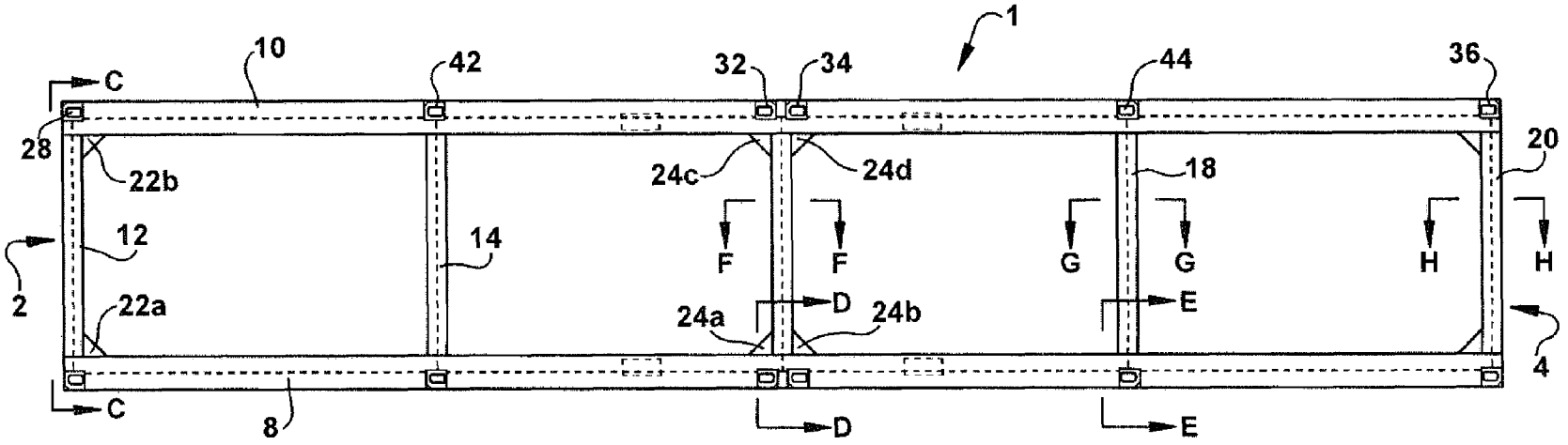
FIG. 2 shows a top view of the cambered frame system shown in FIG. 1 along line A-A.
Figure 3:
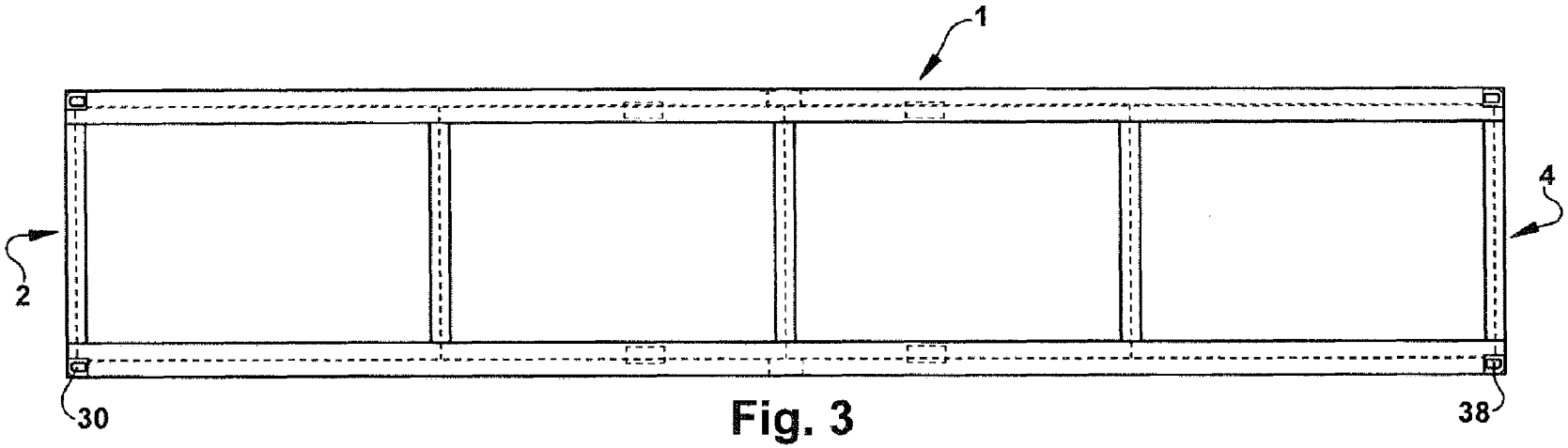
FIG. 3 shows a bottom view of the cambered frame system shown in FIG. 1 along line B-B.

As can be seen in FIGS. 1 and 2, the frame system 1 includes a plurality of horizontal gusset plates 22, 24, 26. The horizontal gusset plates 22, 24, 26 are substantially parallel to the upper and lower surfaces 5, 6 of the frame system 1. A pair of horizontal first beam gusset plates 22 are provided at the first end 2 of the frame system 1. One of the horizontal first beam gusset plates 22*a* interconnects the first cross beam 12 and the first longitudinal beam 8, and the other of the horizontal first beam gusset plates 22*b* interconnects the first cross beam 12 and the second longitudinal beam 10. A pair of horizontal fifth beam gusset plates 26 are provided at the second end 4 of the frame system 1. One of the horizontal fifth beam gusset plates 26*a* interconnects the fifth cross beam 20 and the first longitudinal beam 8, and the other of the horizontal fifth beam gusset plates 26*b* interconnects the fifth cross beam 20 and the second longitudinal beam 10. Four horizontal third beam gusset plates 24 are centrally located between the first end 2 and the second end 4 of the frame system 1. Two of the horizontal third beam gusset plates 24*a*, 24*b* interconnect the third cross beam 20 and the first longitudinal beam 8, and two of the horizontal third beam gusset plates 24*c*, 24*d* interconnect the third cross beam 20 and the second longitudinal beam 10. The frame system 1 may be provided with fewer or more horizontal gusset plates to customize the frame system 1 for a particular application.

As can be seen in FIGS. 1 and 6-11, the frame system 1 also includes a plurality of vertical gusset plates 23, 25, 27, 29, 31. The vertical gusset plates 23, 25, 27, 29, 31 are substantially perpendicular to the upper and lower surfaces 5, 6 of the frame system 1. A pair of vertical first beam gusset plates 23 is provided adjacent the first cross beam 12. One of the vertical first beam gusset plates 23*a* interconnects the first cross beam 12 and the first longitudinal beam 8, and the other of the vertical first beam gusset plates 23*b* interconnects the first cross beam 12 and the second longitudinal beam 10. A pair of vertical second beam gusset plates 25 is provided adjacent the second cross beam 14. One of the vertical second beam gusset plates 25*a* interconnects the second cross beam 14 and the first longitudinal beam 8, and the other of the vertical second beam gusset plates 25*b* interconnects the second cross beam 14 and the second longitudinal beam 10. A pair of vertical third beam gusset plates 27 is provided adjacent the third cross beam 16. One of the vertical third beam gusset plates 27*a* interconnects the third cross beam 16 and the first longitudinal beam 8, and the other of the vertical third beam gusset plates 27*b* interconnects the third cross beam 16 and the second longitudinal beam 10. A pair of vertical fourth beam gusset plates 29 is provided adjacent the fourth cross beam 18. One of the vertical fourth beam gusset plates 29*a* interconnects the fourth cross beam 18 and the first longitudinal beam 8, and the other of the vertical fourth beam gusset plates 29*b* interconnects the fourth cross beam 12 and the second longitudinal beam 10. A pair of vertical fifth beam gusset plates 31 is provided adjacent the fifth cross beam 20. One of the vertical fifth beam gusset plates 31*a* interconnects the fifth cross beam 20 and the first longitudinal beam 8, and the other of the vertical fifth beam gusset plates 31*b* interconnects the fifth cross beam 20 and the second longitudinal beam 10. The frame system 1 may be provided with fewer or more vertical gusset plates to customize the frame system 1 for a particular application.

The frame system 1 further includes a plurality of corner castings 28, 30, 32, 34, 36, 38. The corner castings 28, 30, 32, 34, 36, 38 are of the type known in the ISO-container shipping industry. The first end 2 of the frame system 1 is provided with two first end upper corner castings 28 and two first end lower corner castings 30. The first end upper corner castings 28 and lower corner castings 30 are respectively provided on the upper and lower surface 5, 6 of the frame system 1, and are positioned adjacent the first cross beam 12 on the first and second longitudinal beams 8, 10. The second end 4 of the frame system 1 is provided with two second end upper corner castings 36 and two second end lower corner castings 38. The second end upper corner castings 36 and lower corner castings 38 are respectively provided on the upper and lower surface 5, 6 of the frame system 1, and are positioned adjacent the fifth cross beam 20 on the first and second longitudinal beams 8, 10. The upper corner castings 28, 36 and the lower corner castings 30, 38 are respectively specific to the upper and lower surfaces 5, 6 of the frame 1. That is, the upper corner castings 28, 36 and the lower corner castings 30, 38 are not identical components and cannot be interchanged with one another. Four central corner castings 32, 34 are provided on the upper surface 5 of the frame system 1. The central corner castings 32, 34 are positioned adjacent the third cross beam 16 on the first and second longitudinal beams 8, 10, and are the same type of casting as the type used for the upper corner castings 28, 36. In the illustrated embodiment the upper surface 5 of the frame system 1 is provided with four auxiliary corner castings 42, 44. Two of the auxiliary corner castings 42 are provided adjacent the second cross beam 14, and two of the auxiliary corner castings 44 are provided adjacent the fourth cross beam 18. The frame system 1 may be provided with fewer or more corner castings to customize the frame system 1 for a particular application.

The corner castings 28, 30, 32, 34, 36, 38 adjacent the first, third, and fifth cross beam 12, 16, 20 are provided with a brace assembly 33, 35, 37, 39. Each brace assembly 33, 35, 37, 39 extends substantially between, and perpendicular to, the upper and lower surfaces 5, 6 of the frame system 1. In the case of the corner castings 28, 30, 36, 38 located at the first and second ends 2, 4 of the frame system, the brace assembly 33, 39 interconnects the upper corner castings 28, 36 with the lower corner castings 30, 38. The other brace assemblies 35, 37 interconnect the respective corner casting 32, 34 with the second surface 6 of the frame system 1.

Figure 4:
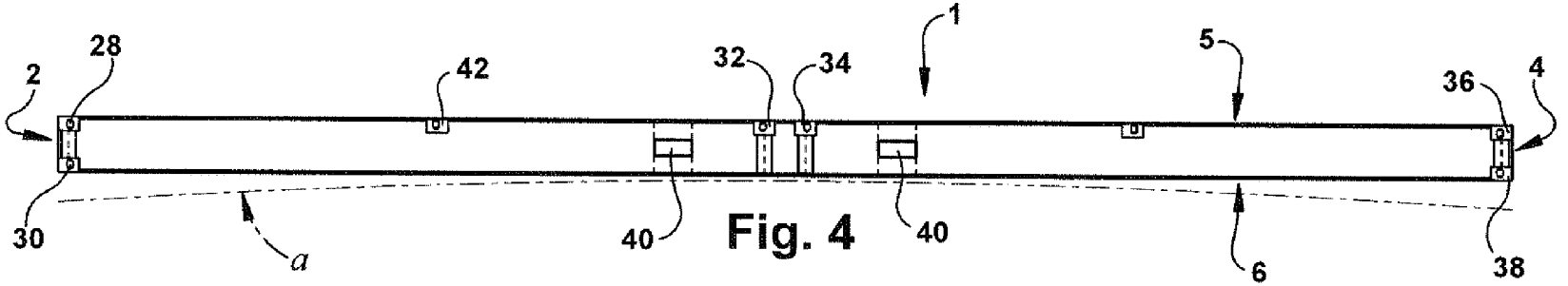
FIG. 4 shows a side view of the cambered frame system shown in FIG. 1 when the cambered frame system is loaded.
Figure 5:
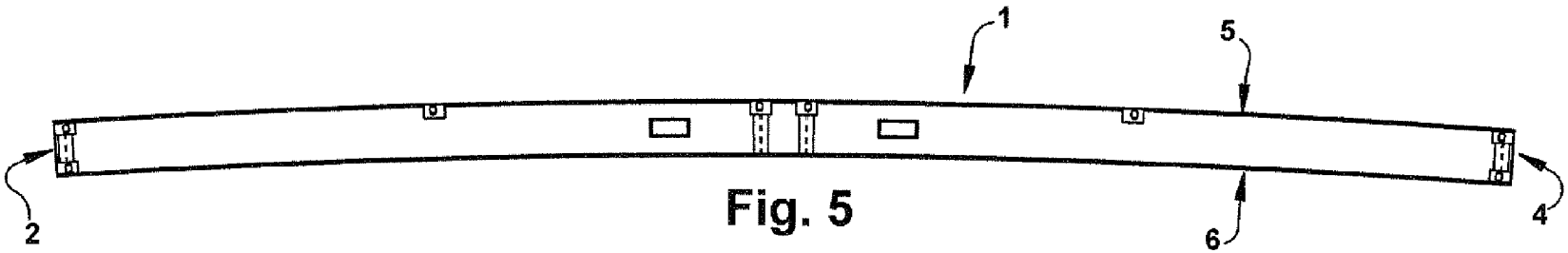
FIG. 5 shows a side view of the cambered frame system shown in FIG. 1 when the cambered frame system is unloaded
Figure 6:
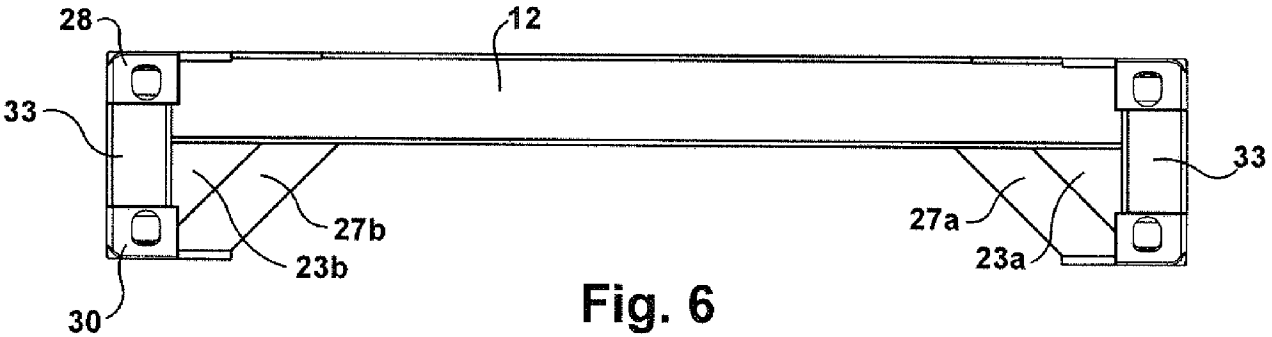
FIG. 6 shows a view of the cambered frame system shown in FIG. 2 along line C-C.
Figure 7:
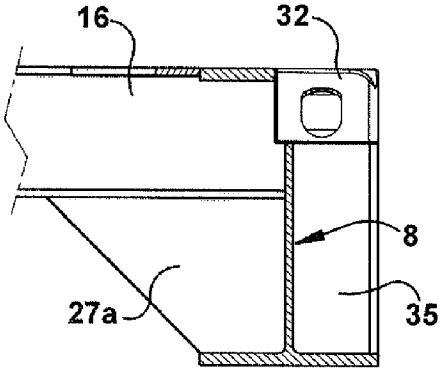
FIG. 7 shows a view of the cambered frame system shown in FIG. 2 along line D-D.
Figure 8:
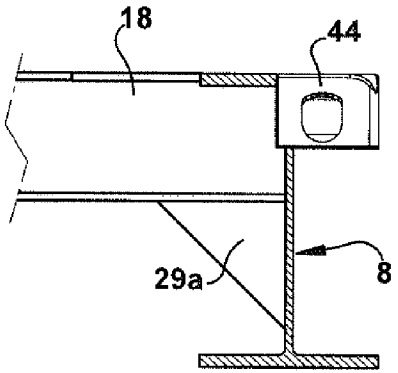
FIG. 8 shows a view of the cambered frame system shown in FIG. 2 along line E-E.
Figure 9:
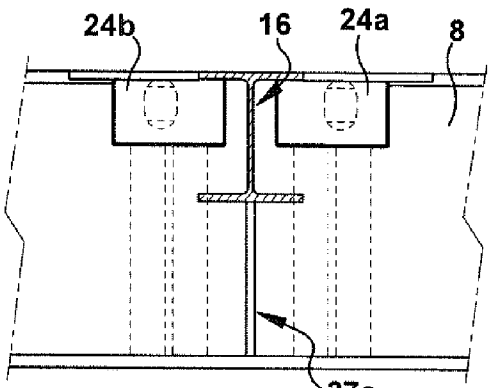
FIG. 9 shows a view of the cambered frame system shown in FIG. 2 along line F-F.
Figure 10:
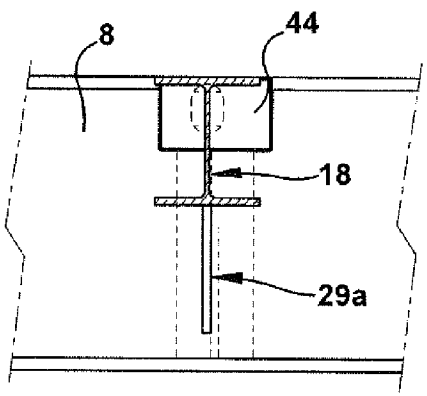
FIG. 10 shows a view of the cambered frame system shown in FIG. 2 along line G-G.
Figure 11:
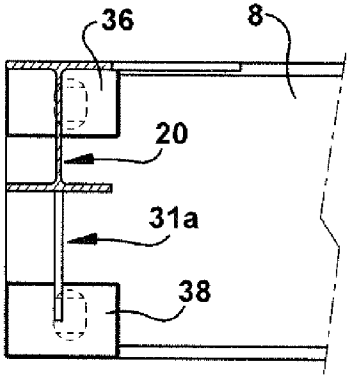
FIG. 11 shows a view of the cambered frame system shown in FIG. 2 along line H-H.

As can be clearly seen in FIGS. 4 and 5, the frame system 1 is cambered (i.e. arched). The camber is achieved by cambering both of the longitudinal beams 8, 10 along the length of beams 8, 10 between the first and second ends 2, 4 of the frame system 1. In other words, when viewed from the perspective shown in FIGS. 4 and 5, the portion of the longitudinal beams 8, 10 adjacent the first end 2 and the second end 4 are lower than the portion of the longitudinal beams 8, 10 adjacent the midpoint between the first and second ends 2, 4. It is understood that design specifications (e.g. beam size and beam camber) of the longitudinal beams 8, 10 may be varied to customize the frame system 1 for a particular application.

Figure 12:
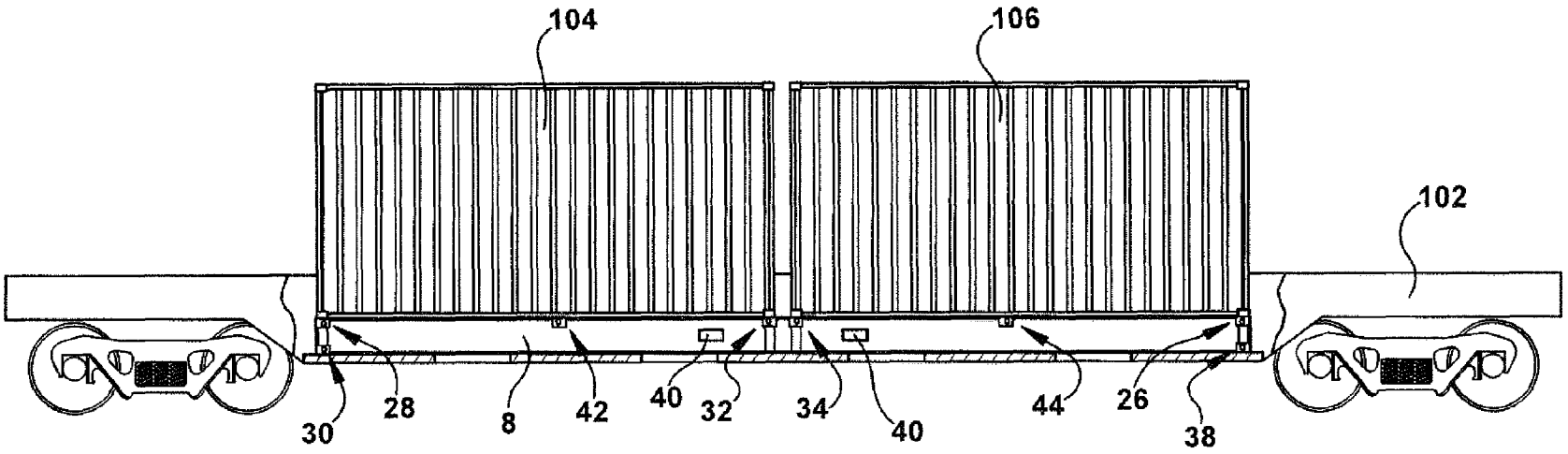
FIG. 12 is a side view of the cambered frame system shown in FIG. 1 loaded in a rail car and carrying two ISO containers.

With attention directed to FIG. 12, one exemplary process for deploying the cambered frame system 1 will now be described. In the described exemplary process, the frame system 1 is being utilized to carry two ISO containers 104, 106 on a rail car 102. However, it is understood that the frame system 1 may be used to carry loads other than ISO containers in environments other than rail cars. Furthermore, it is understood that the frame system 1 may be deployed in a manner other than the one described below.

Figure 14:
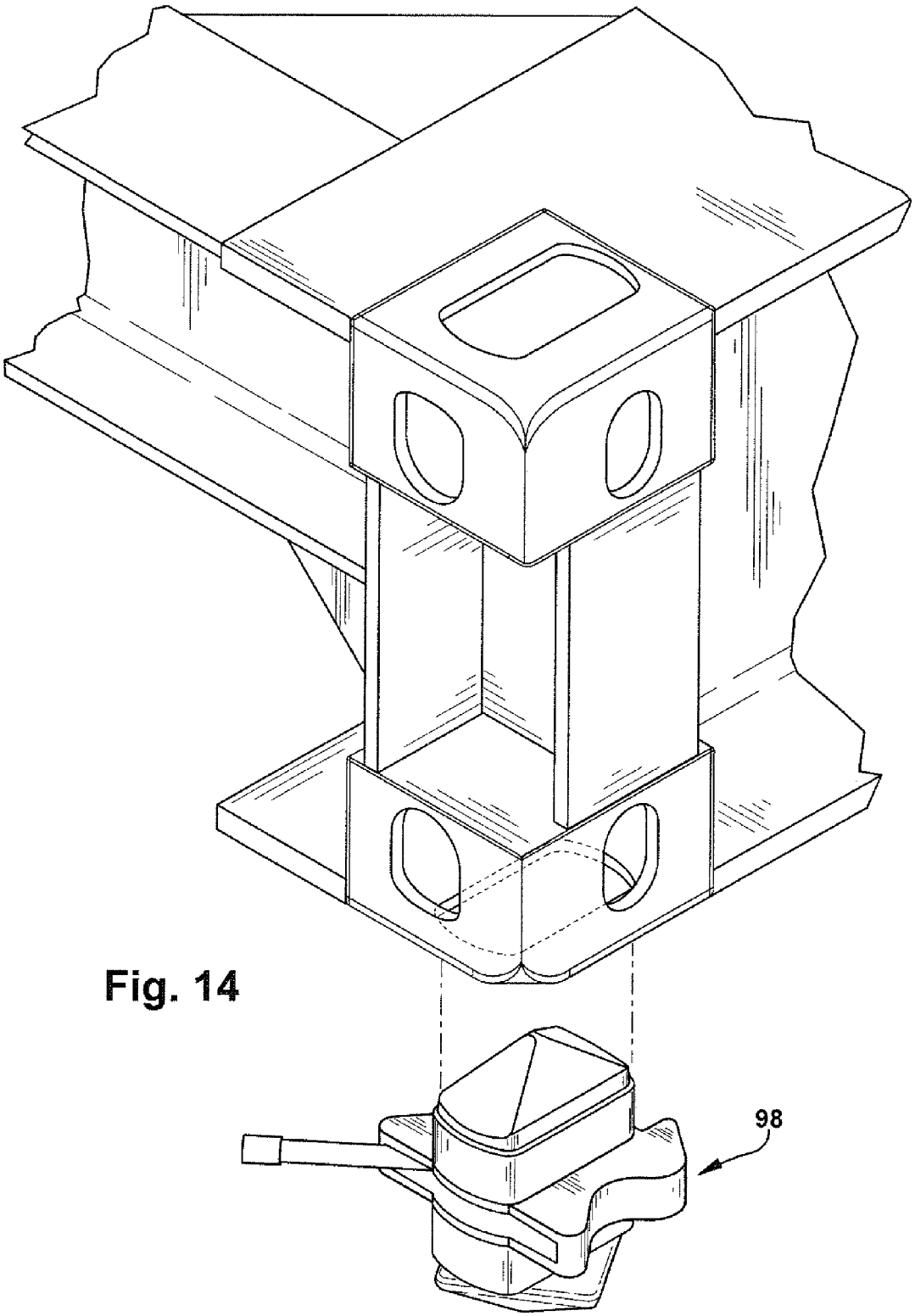
FIG. 14 shows an example embodiment of an interbox connector in relation to a corner casting that may be used with the frame system shown in FIGS. 1-13.

Deployment of the frame system 1 begins with the frame system 1 sitting on a substantially flat surface outside of, but near, the rail car 102. Next, the first 20-foot long ISO container 104 is placed on the frame system 1 such that the first end upper corner castings 28 and two of the central corner castings 32 engage with corner castings provided on the bottom of the first ISO container 104. This placement locates the first ISO container 104 on the frame system 1 such that the first ISO container 104 spans substantially between the first cross beam 12 and the third cross beam 16. Standard interbox connector devices of the type known in the ISO-container shipping industry are installed in the first end upper corner castings 28 and two of the central corner castings 32, and are used to join the corner castings 28, 32 of the frame system 1 to the corner castings on the bottom of the first ISO container 104. An exemplary interbox connector device 98 is shown in FIG. 14. However, it is understood that interbox connector devices having a construction other than the interbox connector device 98 shown in FIG. 14 may be used. The interbox connector devices are then locked, thereby attaching the first ISO container 104 to the frame system 1. Then, interbox connectors are installed in unlocked condition in the second end upper corner castings 36 and two of the central corner castings 34 at the upper surface 5 of the frame system 1. Next, a wheeled top loader, crane, or other lifting mechanism couples to the top of the first ISO container 104 and lifts the first ISO container 104, with the frame system 1 attached, into the intermodal rail car 102. As the first ISO container 102 and the frame system 1 are lowered into the rail car 102, the lower corner castings 30, 38 of the frame system 1 receive positioning cones provided on the rail car 102, thereby securing the frame system 1 on the rail car 102. The positioning cones of the rail car 102 are of the type known in the ISO-container shipping industry. Next, the second 20-foot long ISO container 106 is loaded in the rail car 102 and placed on the frame system 1 such that the second ISO container 106 spans substantially between the third cross beam 16 and the fifth cross beam 20. Corner castings provided on the bottom of the second ISO container 106 receive the interbox connector devices installed in the second end upper corner castings 36 and two of the central corner castings 34, thereby securing the second ISO container 106 on the frame system 1. Unlike the interbox connector devices of the first ISO container 104, the interbox connector devices of the second ISO container 106 are not locked. Optionally, interbox connector devices may be affixed to corner castings provided on the top of the first ISO container 104 to indicate which of the two ISO containers 104, 106 is attached to the frame system 1. The ISO containers 104, 106 are then ready for transport on the rail car 102.

When the frame system 1 is deployed as described above, a substantial proportion of the total load (i.e. the combined weigh of the two ISO-containers 104, 106 and cargo) carried by the frame system 1 is transferred to the first and second ends 2, 4 of the frame system 1. Thus, the frame system 1 removes a substantial percentage of the total load carried by a central portion of the rail car 102 and transfers that percentage toward the ends of the rail car 102 where the rail car trucks are located. Accordingly, the central portion of the rail car 12 is not overly stressed, thereby avoiding structural failure of the rail car 102. The difference between an unburdened and burdened frame system 1 is clearly illustrated in FIG. 5, wherein the burdened frame system 1 is shown alongside a phantom line a showing the lower surface 6 of the unburdened frame system 1.

The ISO containers 104, 106 and frame system 1 must be unloaded once the rail car 102 reaches a desired destination. The unloading process is substantially the reverse of the above described deployment process. First, the second ISO container 106 is lifted from the frame system 1 and removed from the rail car 102. Next, if interbox connector devices were used as indicators on the first ISO container 104, the interbox connector devices affixed to the corner castings on the top of the first ISO container 104 are removed. Then, a wheeled top loader, crane, or other lifting mechanism couples to the top of the first ISO container 104 and lifts the first ISO container 104, with the frame system 1 attached, out of the intermodal rail car 102. Next, the interbox connector devices used to attach the first ISO container 104 to the frame system are unlocked. Finally, the first ISO container 104 is removed from the frame system 1.

Figure 13:
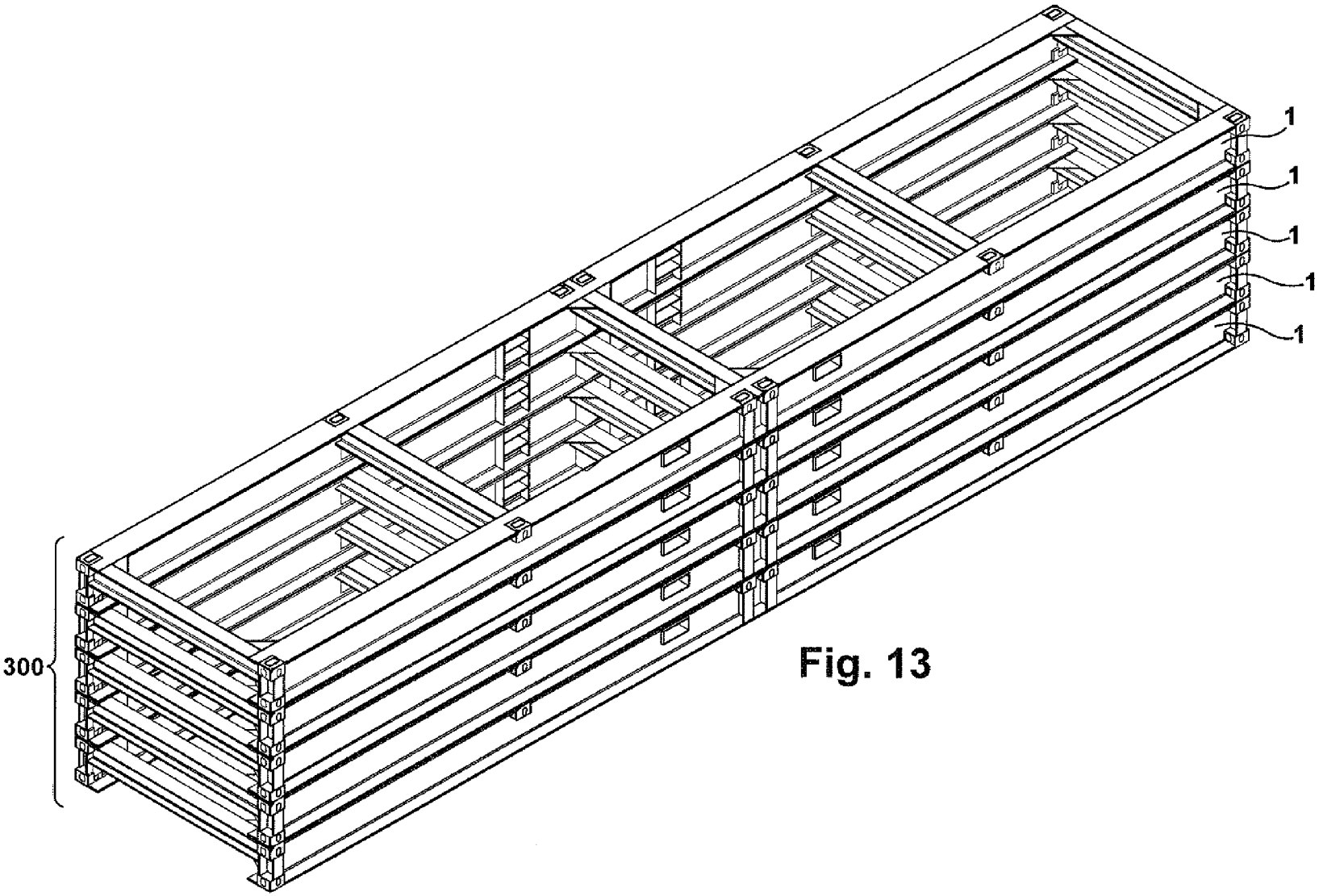
FIG. 13 shows a plurality of cambered systems of the type shown in FIG. 1 arranged to form a frame system stack unit.

In order to maximize cargo transportation efficiency, it may by sometimes necessary to transport a plurality of frame systems 1 between different shipping yards. The plurality of frame systems 1 may be shipped in a frame system stack unit 300, shown in FIG. 13. To create the frame system stack unit 300, a plurality of frame systems 1 are stacked on top of one another such that the upper corner castings 28, 36 and lower corner castings 30, 38 of neighboring frame systems engage one another. Standard ISO interbox connectors are used to attach the stacked plurality of frame systems 1 to one another, thereby creating the frame system stack unit 300. The frame system stack unit 300 may then be lifted as a single integral unit into a rail car by a wheeled top loader, crane, or other lifting mechanism for transportation to a desired shipping yard. The frame system stack unit 300 illustrated in FIG. 13 includes five individual frame systems 1. However, fewer or more individual frame systems 1 may be included in the frame system stack 300 depending on varying terminal operational requirements.

As can be clearly seen in FIGS. 1, 4, 5, 12, and 13, each individual frame system 1 may be provided with a fork lift pocket 40. The fork lift pocket 40 consists of two individual slots that extend through both of the longitudinal beams 8, 10 on either side of the third cross beam 16, and along a plane that extends parallel to the upper and lower surfaces 5, 6 of the frame system 1. The fork lift pocket 40 may be utilized during the creation of the frame system stack 300. Lifting forks of a forklift may be inserted through the fork lift pocket 40 in order to lift, move, or stack the individual frame systems 1 that make up the frame system stack 300. Providing the fork lift pocket 40 allows a standard forklift to assembly and disassemble the frame system stack 300, as well as allowing a standard forklift to move and position individual frame systems 1, thereby freeing up top loading specific machines for other shipping yard operations. However, if a top loading specific machine is available, individual frame systems 1 may be moved and positioned by coupling to the individual frame system 1 via the auxiliary corner castings 42, 44, or by corner castings 28, 36. In the embodiment of illustrated frame system 1, each frame system 1 is provided with a single fork lift pocket 40. However, each frame system 1 may be provided with a plurality of fork lift pockets 40 spaced out along the frame system 1 between the first end 2 and the second end 4 in order to increase the flexibility in which standard forklifts are able to approach the frame system 1 for lifting.

Design criteria for the frame system 1 will now be described. As indicated above, the frame system 1 may utilize longitudinal beams 8, 10 of various design specifications (e.g. beam size and beam camber). Different combinations of longitudinal beam 8, 10 design specifications will result in different downward deflection of the longitudinal beams 8, 10, and, thus, result in a frame system 1 that will transfer different percentages of the total load toward the first and second ends 2, 4 of the frame system 1.

The maximum and the minimum combined weight of the load carried by the frame system 1 must be taken into consideration when designing the frame system 1. With the maximum and minimum combined weight in mind, the selection of the longitudinal beam 8, 10 size and camber must satisfy two key operating principles of the frame system 1. First, the degree of load transfer sought from the frame system 1 toward the first and second ends 2, 4 should be such that the central portion of the rail car 102 does not carry more than an allowable load rating when the frame system 1 is burdened with the maximum combined weight. Allowing more than the allowable load rating to be transferred to the central portion of the rail car 102 could further contribute to the failure of the rail car 102 structure. Second, the frame system 1 should be in continuous contact with the rail car along the length of the longitudinal beams 8, 10 when the frame system 1 is burdened with the minimum combined weight. A frame system 1 that does not adhere to this second operating principle may create a situation in which a gap exists between the lower surface 6 of the frame system 1 and the rail car 102. The rail car 102 may encounter relatively bumpy conditions during transportation. The bumpy conditions may result in the longitudinal beams 8, 10 flexing through the space in the gap and coming into repeated violent contact with the rail car 102, thereby possibly severely damaging the rail car 102.

The above described frame system 1 restores the transportation efficiency of structurally compromised rail cars by allowing the structurally compromised rail cars to carry two fully loaded 20-foot long ISO containers. The foregoing detailed description and examples have been given for clarity of understanding only. No necessary limitations are to be understood therefrom. The cambered frame system is not limited to the exact details shown and described. Variations obvious to one skilled in the art are included within the cambered frame system defined by the claims. For example, it is obvious that numerous omissions can be made without departing from the spirit of the several claims.

Having described the invention, the following is claimed:

1. A method of transporting containers on a rail car comprising the steps of:

providing a frame having at least two longitudinal beams and at least two cross beams, the at least two cross beams extending substantially perpendicular to, and interconnecting, the at least two longitudinal beams;

attaching a first container to a first end of the frame after the step of providing the frame;

loading the first container and the frame into the rail car after the step of attaching the first container; and loading a second container into the rail car and onto a second end of the frame after the step of loading the first container.

2. The method of claim 1, wherein the at least two longitudinal beams are cambered along the length of the beams.

3. The method of claim 1, further comprising the steps of:

unloading the second container from the second end of the frame and out of the rail car;

unloading the first container and the frame out of the rail car; and detaching the first container from the first end of the frame.

4. The method of claim 1, wherein interbox connectors are used in the step of attaching the first container to the first end of the frame.

5. The method of claim 1, further comprising the step of, after the step of loading the second container, marking the first container to indicate the first container is attached to the frame.

6. The method of claim 5, wherein interbox connectors are used in the step of marking the first container.

7. The method of claim 1, wherein the step of loading the first container and the frame into the rail car is realized by attaching a lifting system to the first container.

8. The method of claim 3, wherein the step of unloading the first container and the frame out of the rail car is realized by attaching a lifting system to the first container.

9. The method of claim 1, wherein the frame is provided with at least two slots that extend horizontally through both of the at least two longitudinal beams.

10. The method of claim 1, wherein the frame has a first side and a second side opposite the first side, and wherein the first container is attached to the first side of the frame during the step of attaching the first container, the second side of the frame faces the rail car during the step of loading the first container, and the second container is loaded onto the first side of the frame during the step of the loading the second container.

11. A method of transporting containers on a rail car comprising the steps of:

providing a frame having at least two longitudinal beams and at least two cross beams, the at least two cross beams extending substantially perpendicular to, and interconnecting, the at least two longitudinal beams;

attaching a first container to a first end of the frame;

loading the first container with the frame attached thereto into the rail car; and loading a second container into the rail car and onto a second end of the frame.

* * * * *